US006135166A

United States Patent [19]

Paradies et al.

[11] Patent Number: 6,135,166

[45] Date of Patent: Oct. 24, 2000

[54] FILLING VALVE (TWO SCREENS)

[75] Inventors: Gilbert E. Paradies, Satellite Beach; William H. Mitterholzer, Edgewater, both of Fla.

[73] Assignee: Crown Simplimatic Incorporated, Lynchburg, Va.

[21] Appl. No.: 09/336,789

[22] Filed: Jun. 21, 1999

[51] Int. Cl.[7] ..... B65B 1/04; B65B 3/04; B65B 31/00; B67C 3/00

[52] U.S. Cl. ..... 141/31; 141/37; 141/39; 141/46; 141/52; 141/54; 141/59; 141/286; 141/301; 141/302

[58] Field of Search ..... 141/31, 37, 39, 141/46, 52–59, 62, 286, 301, 302, 146–149, 312; 222/108

[56] References Cited

U.S. PATENT DOCUMENTS 3,415,294 12/1968 Kelly ..... 141/1
4,750,533 6/1988 Yun ..... 141/46
5,085,255 2/1992 LaWarre, Sr. et al. ..... 141/39
5,474,113 12/1995 Rademacher et al. ..... 141/31

*Primary Examiner*—Henry J. Recla
*Assistant Examiner*—Timothy L. Maust
*Attorney, Agent, or Firm*—Howard & Howard

[57] ABSTRACT

A filling valve assembly for filling a container (11) with a fluid material and comprising a valve body (16) having an outer wall (18) defining an inner chamber (20). A vent tube (30) extends upwardly through the chamber (20) for ventilating the container (11) when the container (11) is filled with the fluid material and defining at least one fluid passageway (38) disposed between the outer wall (18) and the vent tube (30) for allowing the fluid material to discharge from the chamber (20) and into the container (11). A first screen (62) is disposed across said fluid passageway (38) and the assembly is characterized by a second screen (64) disposed across the passageway (38) in spaced relationship to and below the first screen (62) whereby the capillary action of both screens (62) and (64) accumulate to more precisely fill successive containers (11) to equal volumes.

7 Claims, 3 Drawing Sheets

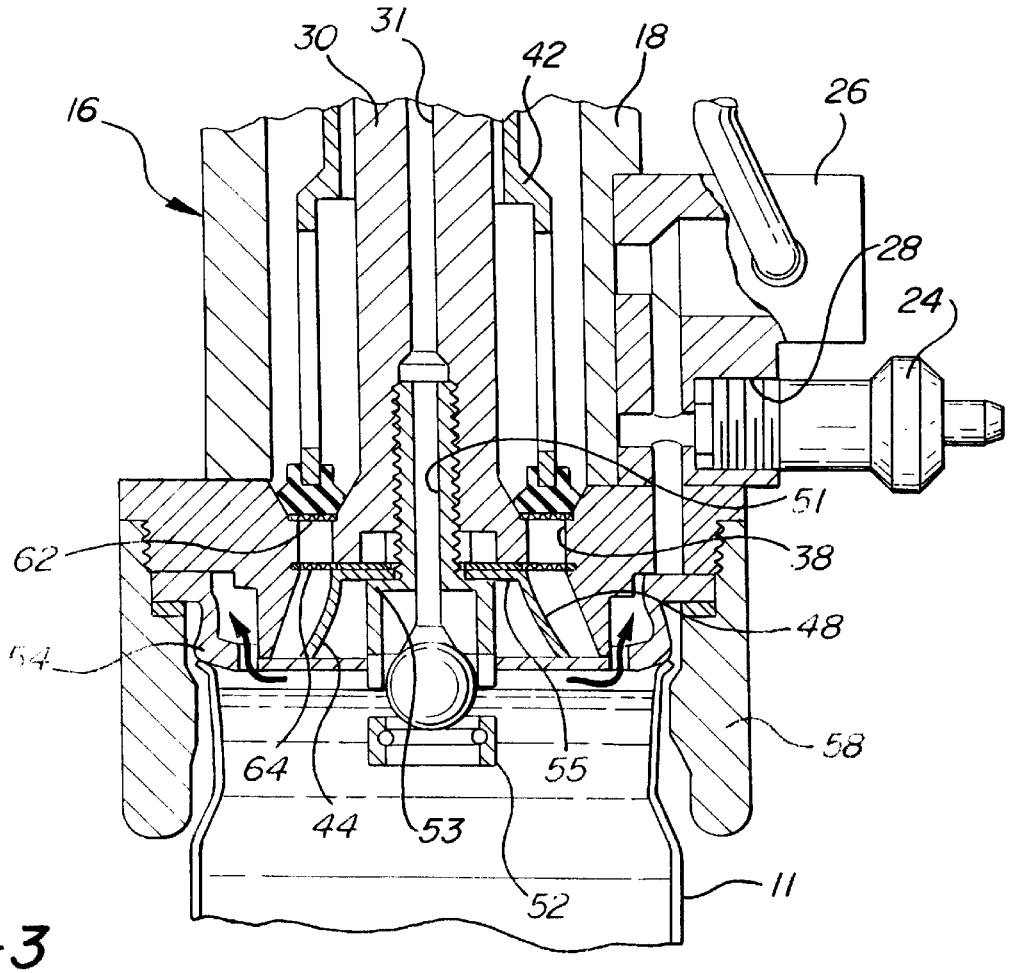
FIG-3
FIG-6
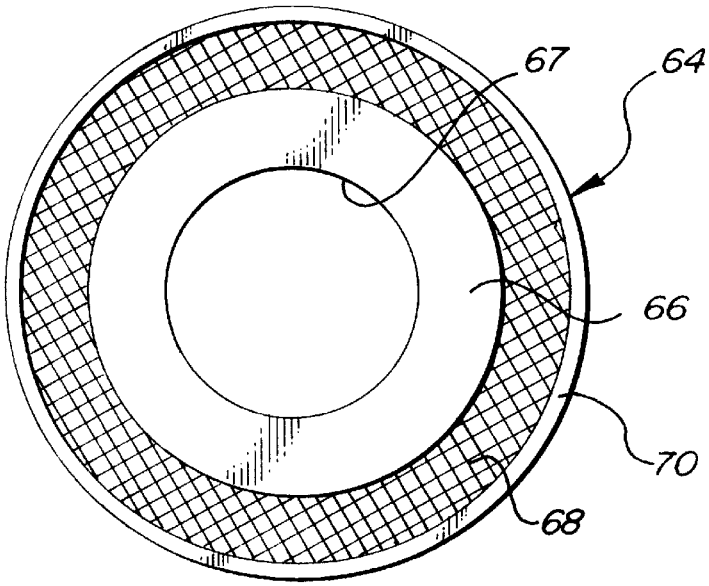

FIG-4
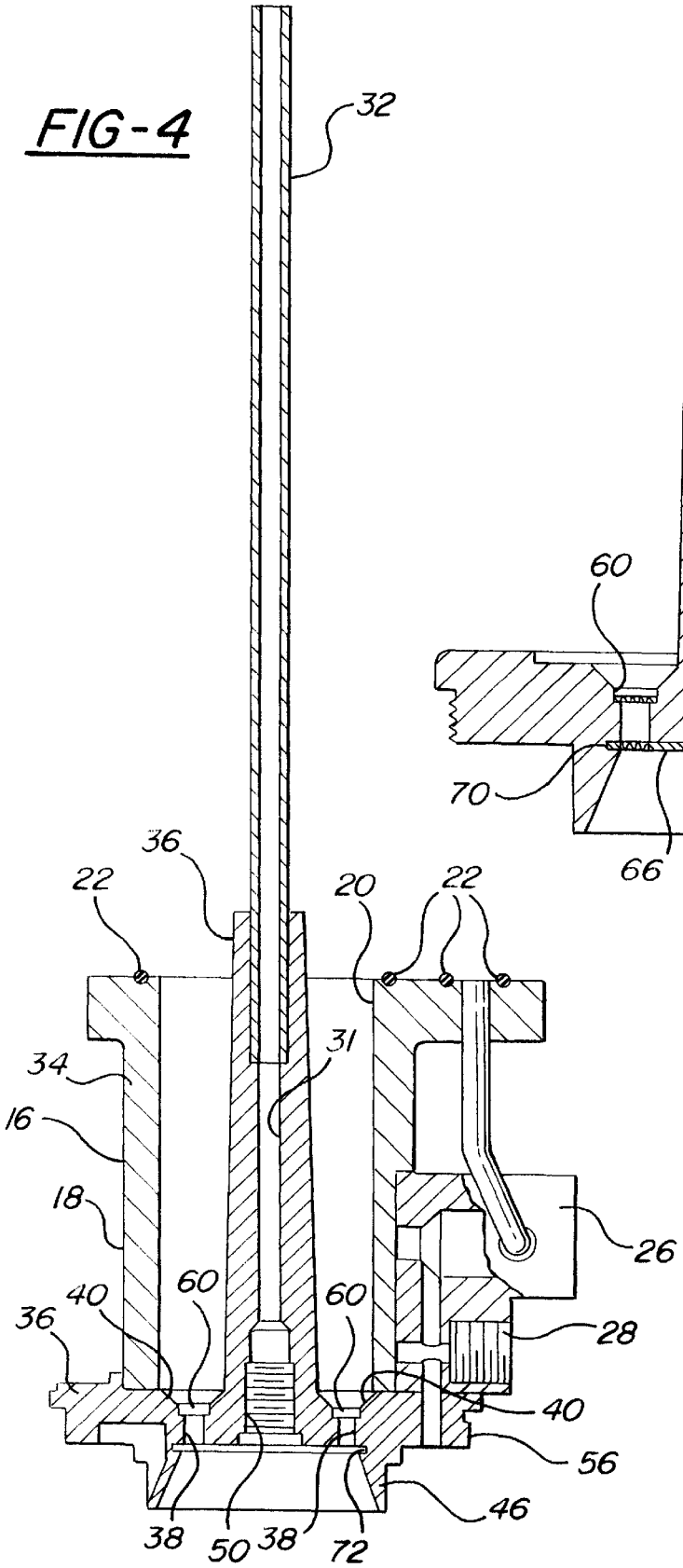
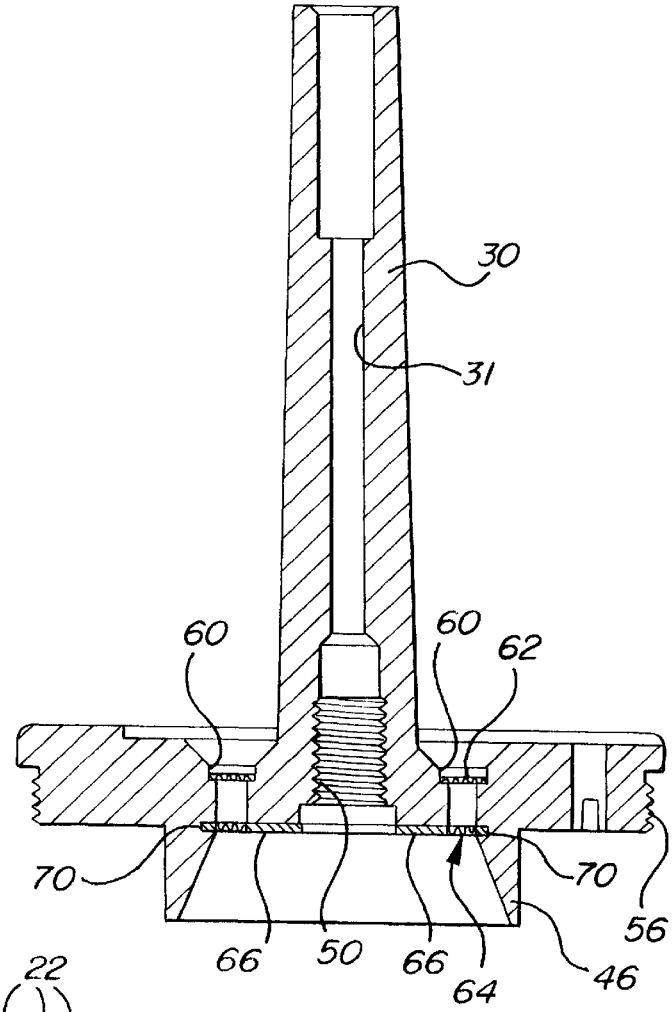
FIG-5

FILLING VALVE (TWO SCREENS)

BACKGROUND OF THE INVENTION

1. Field of the Invention

The subject invention relates filling valve bodies for use in beverage filling machines.

2. Description of the Prior Art

Beverage filling machines used for filling containers, such as cans,jars, or bottles, with a beverage, such as carbonated drinks, juices, water or the like, as are well known in the art. Conventional filling machines feed the containers into a star wheel conveyor which individually positions each container on a rotating turntable below a filling valve assembly. The container moves into sealing engagement with the valve assembly by either moving the container upwardly or by lowering the valve assembly. There may be well over one hundred individual valve assemblies disposed circumferentially around the turntable. The methods and apparatuses for filling the containers with the carbonated liquids have evolved into counter pressure filling machines. These counter pressure filling machines typically operate under relatively high pressures.

In a typical filling operation, the container, which is sealed against the valve assembly, is initially purged with an inert gas for a predetermined time in order to flush air and other impurities from the container. The liquid beverage is then filled into the container through a number of fluid passageways while the gas from the container vents through a vent tube. In order to reduce foaming and splashing of the liquid, the liquid beverage is frequently directed toward the outer walls of the container. This process continues until the container is filled with the liquid. As appreciated, the valve assemblies are designed to prevent leakage of the pressurized liquid when the container is not present.

The beverage filling industry continuously strives for machinery features and methods which facilitate rapid, economical, efficient, sterile and accurate filling of containers. One such feature is the mounting of a capillary screen within the fluid passageway near a sealing device of the filling valve. The natural surface tension of the liquid on the screen will prevent further liquid from flowing into the container, thereby maintaining the fill height of each container substantially equal. The mesh size of the screen depends upon the viscosity and surface tension of the liquid. Accordingly, the capillary screen stops flow of liquid into the container. Nevertheless, the tolerances of the volume of liquid in filled containers from container to container still varies while it remains an objective to fill each successive container to exactly equal amounts.

SUMMARY OF THE INVENTION AND ADVANTAGES

The subject invention is incorporated in a filling valve assembly for filling a container with a fluid material, which comprises a valve body having an outer wall defining an inner chamber, a vent tube extending upwardly through the chamber for venting the container when the container is filled with the fluid material and defining at least one fluid passageway disposed between the outer wall and the vent tube for allowing the fluid material to discharge from the chamber and into the container, and a first screen disposed across the fluid passageway. The assembly is characterized by a second screen disposed across the passageway in spaced relationship to the first screen.

Accordingly, the subject invention reduces the filling tolerances from container to container by providing a plurality of capillary screens in series whereby the capillary action of both screens accumulate to more precisely fill successive containers to equal volumes.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a view like FIG. 1 but showing the container in the filled position;

FIG. 4 is a cross sectional view of the valve body and vent tube with which the invention is combined;

FIG. 5 is a cross-sectional view of the vent tube and a portion of the outer wall; and FIG. 6 is a plan view of the second screen.

DETAILED DESCRIPTION OF THE PREFERRED EMBODIMENT

Referring to the Figures, wherein like numerals indicate like or corresponding parts throughout the several views, a filling valve assembly for filling a container with a fluid material is generally shown at 10.

Figure 1:
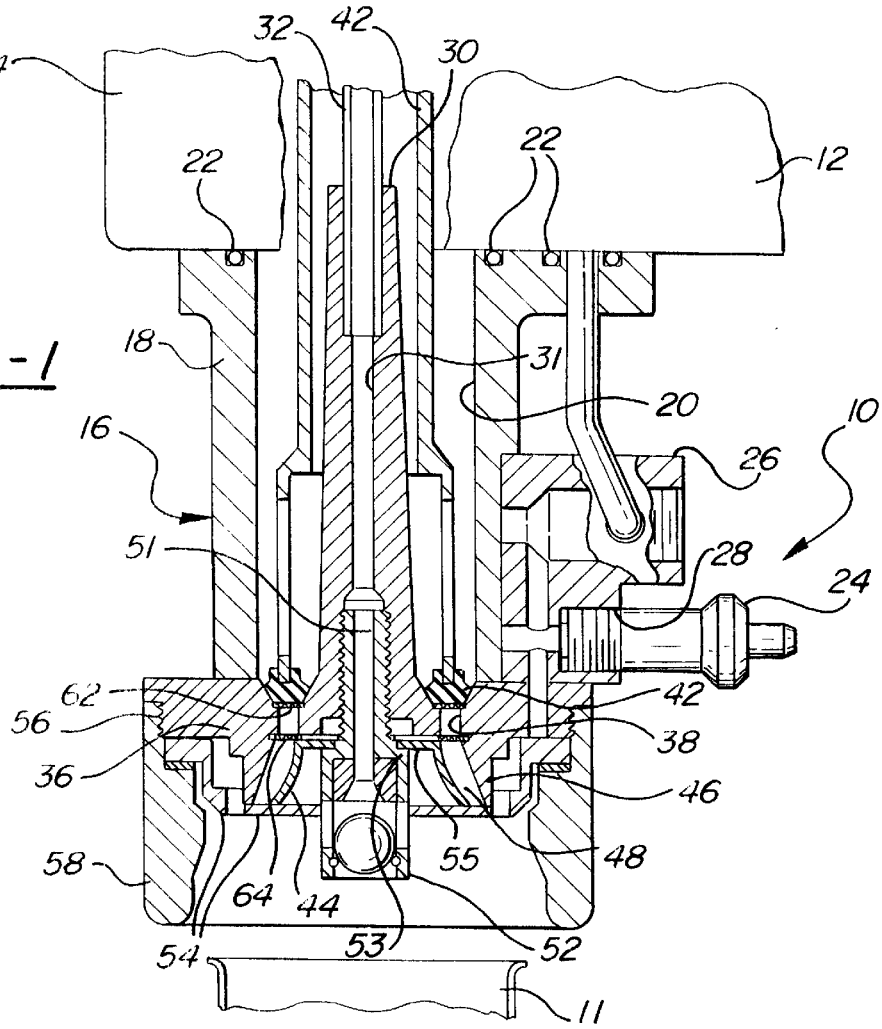
FIG. 1 is a fragmentary cross sectional view of a valve combination incorporating the subject invention and with a container in spaced relationship thereto.

The filling valve assembly 10 could fill any type of container 11, such as a can, jar or bottle, with any type of fluid material, such as carbonated drinks, juices, water or the like. The filling valve assembly 10 is part of a beverage filling machine which includes a series of conveyors, tanks and support platforms as are well known in the art. As shown in FIG. 1, the filling machine includes a support housing including an inner fluid tank or ring bowl; for illustrative purposes, both the support housing and fluid tank are shown schematically at 12. A typical ring bowl has an annular configuration and contains the liquid or beverage material for filling the containers 11. A space is disposed above the liquid for providing a headspace for a pressurized inert gas such as carbon dioxide or nitrogen. A common storage tank or reservoir (not shown) feeds the ring bowl with the required liquid and gas.

The valve assembly 10 comprises a valve body, generally shown at 16, having an outer wall 18 defining an inner chamber 20. As illustrated in FIG. 4, the valve body 16 is shown in its entirety with few additional parts. The inner chamber 20 is open to the fluid tank 14 within the support housing 12 such that the chamber 20 holds the liquid beverage before dispensing into the container 11. A plurality of seals 22 are mounted to the top of the outer wall 18 of the valve body 16 for sealing engagement with the support housing 12. Additional valve devices, such as snift valves 24 and CIP valves, may be mounted to threaded inserts 26 and 28 within the outer wall 18 to assist in the operation of the filling machine.

A vent tube 30 extends upwardly through the inner chamber 20 for venting the container 11 when the container 11 is filled with the fluid material. Preferably, a vent tube extension 32 extends upwardly from the vent tube 30. The vent tube 30 may be of a unitary design or may be formed of multiple parts as shown.

As best illustrated in FIGS. 4 and 5, the outer wall 18 is preferably formed in two separate portions 34,36.

Specifically, the outer wall 18 has an upper portion 34 and a lower portion 36. The upper portion 34 substantially forms the wall for defining the inner chamber 20 and the lower portion 36 is integrally formed with the vent tube 30. The upper portion 34 of the outer wall 18 is separately machined and then fixedly welded to the lower portion 36. As appreciated, the portions 34,36 of the outer wall 18 and the vent tube 30 may be machined from a single piece of metal in order to eliminate the need for welding the portions 34,36 together. Only the lower portion 36 and the vent tube 30 are shown in FIG. 5 (the upper portion 34 of the outer wall 18, which includes the threaded inserts 26 and 28, is absent from the lower portion 36 of the outer wall 18). The vent tube 30 has a bottom end and a vent or passage 31 extending upwardly from the bottom and through the extension 32 for ventilating the container 11.

At least one fluid passageway 38 is defined between the outer wall 18 and the vent tube 30 for allowing the fluid material to discharge from the inner chamber 20 and into the container 11. Preferably, the fluid passageway 38 is formed between the lower portion 34 of the outer wall 18 and the vent tube 30. Even more preferably, there are a number of fluid passageways 38, such as four, each extending arcuately around the vent tube 30 below the chamber 20. Although not shown, the fluid passageways 38 have a curved oval configuration as is known in the art. The fluid passageways 38 span the circumference of the vent tube 30 and are separated by short solid sections. As appreciated, there may be any number of passageways having any type of configuration so long as the fluid material can adequately flow from the inner chamber 20 into the container 11.

A sealing surface 40 is disposed above each of the fluid passageways 38. Preferably, the sealing surface 40 flares outwardly in a frusto-conical configuration. A sealing device 42 is movably mounted relative to the valve body 16 for selectively engaging the sealing surface 40 to control the discharge of fluid material into the container 11. Specifically, the sealing device 42 includes a seal (not numbered) for selective engagement with the sealing surface 40 thereby effectuating the sealing engagement with the fluid passageways 38. A control device (not shown) controls the selective engagement of the sealing device 42 with the sealing surface 40. The movement of the control device and sealing device 42 control the flow of fluid material from the fluid tank and inner chamber 20 into the container 11. The sealing device 42 and control device may be of any suitable design as is well known in the art.

Referring to FIGS. 1 through 4, a deflector 44 is fixedly secured to the valve body 16. The deflector 44 has an outwardly curved surface extending transversely across the fluid passageway 38 for deflecting the fluid material discharging from the inner chamber 20 toward a peripheral wall or side of the container 11. The deflector 44 is fixedly secured to the valve body 16 such that the curved surface remains adjacent to the fluid passageway 38 and extends entirely across the fluid passageway 38 during the discharge of fluid material into the container 11.

An outlet flange 46 extends downwardly from the outer wall 18 and has inner and outer surfaces with the inner surface angling outwardly from the fluid passageway 38. The deflector 44 curves outwardly toward the inner surface of the flange 46 to define an angled or curved channel 48 between the deflector 44 and the flange 46. In other words the curved channel 48 extends the fluid passageway 38 to the distal end of the flange 46. This flange 46 and deflector 44 configuration is known in the art as a tipless valve design. As appreciated by those skilled in the art, the liquid beverage must flow down the peripheral or outside walls of the container 11 in order to eliminate splashing and foaming of the liquid material. The outwardly curved surface further assists in directing the flow of liquid material to the peripheral walls of the container 11.

In order to have the flow of fluid operate effectively, the curved channel 48 formed between the deflector 44 and flange 46 must not be greater than the fluid passageway 38 formed between the lower portion 34 of the outer wall 18 and vent tube 30. Specifically, the fluid passageway 38 has a first width and the channel 48 has a second width with the first width being preferably equal to or greater than the second width. In other words, the curved channel 48 must have an equal or smaller width than the fluid passageways 38. The smaller, or equal, width curved channel 48 helps ensure that there is a minimal amount of foaming and splashing from the liquid. Of course, the deflector 44 may have any suitable curved design so long as the above parameters are achieved.

The vent tube 30 includes a female threaded portion 50, illustrated best in FIGS. 4 and 5, with a valve or ball cage 52 having a hollow spindle 51 extending upwardly from a shoulder 53 and threadedly engaging the threaded portion 50 of the vent tube 30. The valve cage 52 has a ball check valve disposed therein as is well known in the art of check valves. The deflector 44 includes a disk-like mounting portion 55 sandwiched between the valve cage and the bottom of the vent tube. The deflector 44 is wedged between the shoulder 53 of the ball cage 52 and the bottom of the vent tube 30 whereby the ball cage 52 fixedly mounts the deflector 44 to the valve body 16. Specifically, the spindle 51 of the ball cage 52 extends through the center of the mounting portion 55 of the deflector 44 to secure the deflector 44 to the bottom of the vent tube 30. As appreciated, the ball cage 52 is provided for this particular type of counter pressure filling machine but may be replaced by any suitable attachment device so long as the deflector 44 is secured to the bottom of the vent tube 30.

A container seal 54 is disposed about the outer surface of the outlet flange 46 for sealing the container 11 to the valve body 16 when the container 11 is filled with fluid material. The outer wall 18 also has a number of threads 56 wherein a sleeve 58 may be threaded onto the valve body 16. The container seal 54 is sandwiched between the valve body 16 and the sleeve 58. The design of this valve body 16 requires a specific container seal configuration which is disclosed in U.S. Pat. Nos. 4,750,533; 4,986,318; and 5,145,008.

As shown in FIG. 4, a notch 60 extends laterally into each of the outer wall 18 and the vent tube 30 and a first capillary screen 62 is disposed across the fluid passageway 38 and has inner and outer diameters extending into the notches 60. The specific configuration of the screen 62 and the notches which may be used in the combination of the subject invention forms the subject matter of a co-pending application assigned to the assignee of the subject invention. As appreciated, the notches 60 may be of any size having any suitable angle so long as the screen 62 is effectively inserted and adequately retained in position across the fluid passageway 38.

The assembly is characterized by a second screen 64 disposed across the passageway 38 in spaced relationship to the first screen 62 whereby the capillary action of both screens 62 and 64 accumulate to more precisely fill successive containers 11 to equal volumes.

The sealing surface 40 is disposed above the fluid passageway 38 and the sealing device 42 is movably mounted relative to the valve body 16 for selectively engaging the sealing surface 40 to control the discharge of fluid material serially through the screens 62 and 64 and into the container 11. The first screen 62 is disposed immediately below and adjacent the sealing surface 40 and the second screen 64 is disposed below and downstream of the first screen 62.

As alluded to above, the cage 52 defines a retainer attached to the bottom of the vent tube 30 and the second screen 64 is sandwiched between the shoulder 53 of the cage 52 and the bottom of the vent tube 30 to extend across the passageway 38 to engage the outer wall 18 of the chamber 20. More specifically, and as shown in FIG. 6, the second screen 64 includes a solid inner disk 66 sandwiched, along with the mounting portion 55 of the deflector 44, between the shoulder 53 of the cage 52 and the bottom of the vent tube 30. Of course, the solid inner disk 66 has a center hole 67 for disposition around the spindle 51 of the cage 52. The second screen 64 includes a screen ring 68 surrounding the solid disk 66 and disposed in the passageway 38. The second screen 64 may be woven or etched, but as illustrated includes an outer ring 70 to provide a solid perimeter to the woven screen ring 68. This outer ring 70 is disposed in a notch 72 (shown in FIG. 4) in the outer wall of the passageway 38.

Figure 2:
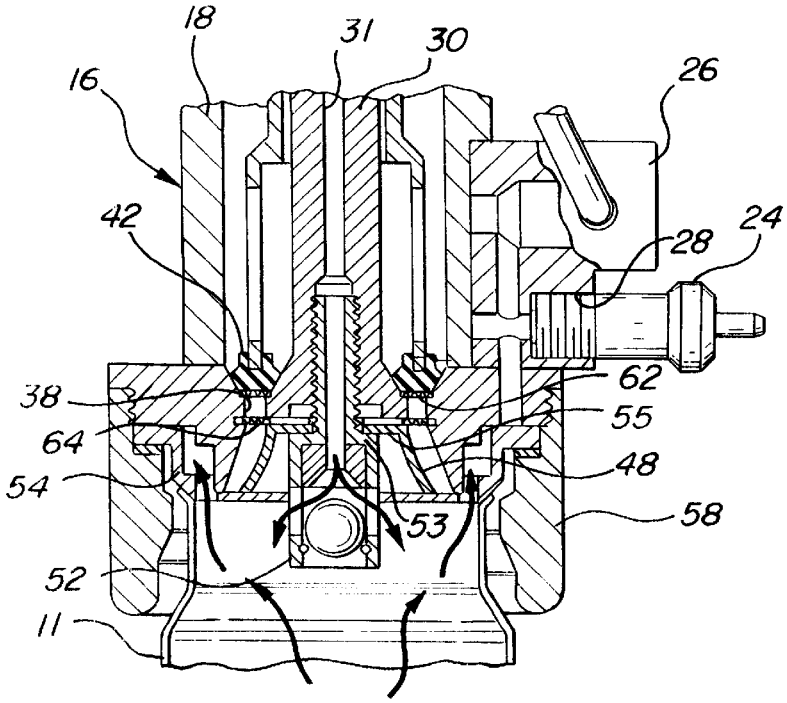
FIG. 2 is a view like FIG. 1 but showing the container in the filling position.

In a typical filling operation, the container 11 is spaced from the filling valve assembly 10 as shown in FIG. 1. The sealing mechanism seals the fluid passageways 38 such that no liquid material drips or leaks from the inner chamber 20. The container 11 then moves into sealing engagement with the container seal 54 as shown in FIG. 2. The container 11 is then purged with the inert gas from the ring bowl for a predetermined time in order to flush air and other impurities from the container 11. The purging by the inert gas is illustrated by the arrows. The inert gases passes through the vent tube 30 around the ball cage 52 and into the container 11.

The liquid is then filled into the container 11 from the ring bowl while the gas from the container 11 vents through the vent tube 30 into the headspace. The gas pressure in the container 11 and the ring bowl are equalized when filling begins. This is what is known as counter pressure which allows the liquid to flow into the container 11 solely under the influence of gravity. In order to reduce foaming and splashing of the liquid, the liquid material is directed toward the sides of the container 11 by the deflector 44. This filling process continues until the container 11 is filled with the liquid as shown in FIG. 3. The container 11 is now wedged between the container seal 54 and the sleeve 58. In addition, the ball within the ball cage 52 has moved upward to block the air passageway into the vent tube 30. Gas is then released from the top of the container 11 to the atmosphere through the snift valve 24 by an process commonly known as "snifting". The filled container 11 is then lowered and passed to a capping station as is known in the art.

The second screen 64 improves valve performance and repeatability in a much closer range of volumes. Because the second screen 64 is separated vertically sufficiently from the top or first screen 62, there is no apparent loss in the speed of fluid flow. At the same time, the appearance of the fluid in the container 11 is improved with less foam. In addition, the range between allowable high and low fill averages has improved.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein that which is prior art is antecedent to the characterized novelty and reference numerals are merely for convenience and are not to be in any way limiting, the invention may be practiced otherwise than as specifically described.

What is claimed is:

1. A filling valve assembly for filling a container (11) with a fluid material, said assembly comprising;

a valve body (16) having an outer wall (18) defining an inner chamber (20);

a vent tube (30) extending upwardly through said chamber (20) for ventilating the container (11) when the container (11) is filled with the fluid material and defining at least one fluid passageway (38) disposed between said outer wall (18) and said vent tube (30) for allowing the fluid material to discharge from said chamber (20) and into the container (11), said vent tube (30) including a bottom end and a vent (31) extending upwardly from said bottom for ventilating the container (11);

a first screen (62) disposed across said fluid passageway (38);

a second screen (64) disposed across said passageway (38) in spaced relationship to said first screen (62) whereby the capillary action of both screens (62 and 64) accumulate to more precisely fill successive containers (11) to equal volumes; and a retainer (53) attached to said bottom of said vent tube (30), said second screen (64) being sandwiched between said retainer (53) and said bottom of said vent tube (30) to extend across said passageway (38) to engage said outer wall (18) of said chamber (20).

2. An assembly as set forth in claim 1 including a sealing surface (40) disposed above said fluid passageway (38) and a sealing device (42) movably mounted relative to said valve body (16) for selectively engaging said sealing surface (40) to control said discharge of fluid material through said screens (62 and 64) and into the container (11).

3. An assembly as set forth in claim 2 wherein said first screen (62) is disposed adjacent said sealing surface (40) and said second screen (64) is disposed downstream of said first screen (62).

4. An assembly as set forth in claim 3 wherein said second screen (64) includes a solid inner disk (66) sandwiched between said retainer (53) and said bottom and a screen ring (70) surrounding said solid disk and disposed in said passageway (38).

5. An assembly as set forth in claim 4 wherein said outer wall (18) includes at least one notch (60 and 72) for receiving and retaining at least one of said screens.

6. An assembly as set forth in claim 4 wherein said retainer (53) comprises a valve cage (52) and a check valve disposed therein.

7. An assembly as set forth in claim 6 including a deflector (44) having an outwardly flared surface (48) extending annularly about and downwardly from said bottom for deflecting the flow of material flowing from said second screen (64) outwardly, said deflector having a disk-like mounting portion (55) sandwiched along with said second screen (64) between said valve cage (52) and said bottom of said vent tube (30).

* * * * *